US006356644B1

(12) United States Patent
Pollak

(10) Patent No.: US 6,356,644 B1
(45) Date of Patent: Mar. 12, 2002

(54) EARPHONE (SURROUND SOUND) SPEAKER

(75) Inventor: Alex Pollak, Burlington (CA)

(73) Assignees: Sony Corporation (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/026,976

(22) Filed: Feb. 20, 1998

(51) Int. Cl.[7] ..... H04R 25/00; H04R 5/02

(52) U.S. Cl. ..... 381/371; 381/370; 381/309; 381/380; 181/129

(58) Field of Search ..... 381/1, 17–19, 381/300, 301, 309, 310, 26, 74, 99, 182, 370, 371, 384, FOR 126, FOR 149, FOR 165, 328; 181/128, 129, 130, 135; D14/205; 379/430

(56) References Cited

U.S. PATENT DOCUMENTS

| | | | | | |
|---|---|---|---|---|---|
| 3,794,779 | A | * | 2/1974 | Greuzerd et al. | 381/371 |
| 3,796,840 | A | * | 3/1974 | Ohta | 381/310 |
| 3,863,028 | A | * | 1/1975 | Fixler | 381/371 |
| 3,943,304 | A | * | 3/1976 | Piribauer | 381/182 |
| 3,984,636 | A | * | 10/1976 | Turner et al. | 381/309 |
| 3,984,885 | A | * | 10/1976 | Yoshimura et al. | 381/309 |
| 4,087,631 | A | * | 5/1978 | Yamada et al. | 381/74 |
| 4,143,244 | A | * | 3/1979 | Iwahara et al. | 381/74 |
| 4,821,323 | A | * | 4/1989 | Papiernik | 381/370 |
| 5,333,206 | A | * | 7/1994 | Koss | 381/309 |
| 5,740,254 | A | * | 4/1998 | Thompson et al. | 381/74 |

FOREIGN PATENT DOCUMENTS

| | | | | |
|---|---|---|---|---|
| JP | 52-30418 | * | 3/1977 | 381/FOR 149 |
| JP | 53-23601 | * | 3/1978 | 381/FOR 149 |
| JP | 3-128598 | * | 5/1991 | 381/FOR 149 |

* cited by examiner

*Primary Examiner*—Xu Mei
(74) *Attorney, Agent, or Firm*—Rader, FIshman & Grauer PLLC; Ronald P. Kananen, Esq.

(57) ABSTRACT

A headphone system that including casings that each contain at least two speakers. Each speaker in each casing is able to produce sounds of different frequencies and/or coming from separate channels. The headphone set may include an electrical device for separating one or more individual signals into two or more signals. The electrical device may be located directly on the headset.

24 Claims, 4 Drawing Sheets

EARPHONE (SURROUND SOUND) SPEAKER

BACKGROUND OF THE INVENTION

1. Field of the Invention

This invention relates generally to the field of multiple channel audio systems. More particularly, this invention relates to an apparatus for providing a surround sound system having multiple channels to provide a more realistic three dimensional sound which is particularly advantageous to theater applications such as home entertainment systems. Finally, this invention relates to an apparatus for privately enjoying realistic, three dimensional sound.

2. Background

Modern day stereo audio reproduction systems provide sound reproduction more realistic than monophonic systems because two soundfields are utilized to give the listener an impression closer to that of alive performance which generates sound from multiple sources located at multiple points in space relative to the listener. However, to more truly reproduce live performances, considerably more than two soundfields are needed.

In fact, low and high frequency sounds which are heard by a listener arrive via multiple paths. In addition to a direct, simultaneous arrival, high and low sounds often are reflected or bounced off walls and objects prior to arriving at the listener's ears. Depending upon their source and line of transmission, sounds may be characterized as direct, reverberations, and indirect late reverberations which may be measured with digital computing equipment. The multiple arrival of sound causes perceptibly phase shifted signals.

There is therefore a need for stereo sound systems that reproduce direct sounds, reverberations, and indirect late reverberations. Recent stereo reproduction systems provide more realistic sound reproduction than ever before by utilizing multiple channels to separate low frequencies from high frequencies. Multiple channels in a surround sound™ system may also separate and delay secondary sound features such as echo and reverberation, from primary sound features including voices and "mid-range" tones. Additionally, even more channels can separate signals. The signals may be broadcast at varying angles relative to a listener to provide an effect of hearing different sounds from different directions.

Conventional surround sound™ systems include a plurality of speakers distributed across the front of a room or theater, with three dimensional sound speakers located along each side of the room or theater. In such an arrangement, a viewing screen is located on or near a front wall. The front speakers include at least a left channel speaker and a right channel speaker. Other speakers may be included. For example, in an eight channel system, a sub-woofer for reproducing extreme lower frequency sounds, and center left and center right channel speakers are included. Left and right surround speakers are mounted on side walls or stands to produce the effect of surrounding the audience in the seating area. Encoded signals in a surround sound™ system can be processed using the methods described in U.S. Pat. No. 5,642,423 assigned to Sony™ Corporation, which is hereby incorporated by reference.

One of the problems associated with three dimensional sound technology is the amount of room such a system takes up. The complexity of the system requires speakers to be spaced around a room. When the side speakers are spaced a significant distance from the front speakers, sound separation is maximized. An even more realistic effect is provided when back speakers are provided a considerable distance from the front and side speakers. There is a need for a surround sound™ system that uses very little room and yet provides realistic surround sound.

Another problem with home or theater three dimensional sound systems is the lack of a three dimensional sensation a listener feels if he or she is not positioned correctly relative to the speakers. A person positioned very close to some side or back speakers, and relatively far from other speakers, will not be able to perceive the entire effect of the sound separation. Accordingly, there is a need for a surround sound™ system that allows a listener to freely roam throughout a room while still perceiving the effect of three dimensional sound.

Furthermore, conventional home surround sound™ systems do not allow a person to listen in privacy. Everyone present in or near a room that is equipped with three dimensional sound speakers must hear whatever is being transmitted, regardless of whether they desire to listen. It is clear there is a need for a surround sounds™ system capable of being listened to by as few as one person, even if other people are in the same room as the listener.

SUMMARY OF THE INVENTION

It is an object of the present invention to meet the above-described needs and others. Specifically, it is an object of the present invention to provide a surround sound™ headphone system. Other objects and advantages of the present invention may be identified by reading the following detailed description, practicing the invention, or considering the appended claims.

To achieve these objects and others, an exemplary embodiment of the present invention may include: A stereo headphone set which includes a headset including left and right casings. The left casing may be positioned near or against a user's left ear when in use, and the right casing may be positioned near or against the user's right ear when in use. Two sets of speakers are attached to or housed within the casings. Each set of speakers may include one or more high frequency speakers producing higher frequency sounds than other speakers that are in the set. Each speaker in each set may be capable of receiving individual signals from separate channels.

The stereo headphone set may include an electrical device for separating one or more individual signals into two or more signals. The separation may result in one signal that transmits sounds of higher frequencies than those transmitted by remaining signals. In one embodiment of the invention, the separating device may be located directly on said headset. In another embodiment, the separating device may be located on a plug. The plug may be attached to the headset by a cord. The plug may be adapted to combine with and receive signals from a port located in a remote stereo sound system.

The stereo headphone set may include a delaying device for delaying at least one of said separated signals before it is transmitted to a speaker. The delayed signal may be channeled to one speaker, or set of speakers, while the signal that is not delayed may be channeled to other speakers. This separation and delay procedure produces an echo or reverberation effect for a listener when he or she hears the delayed signal or signals.

In a preferred embodiment of the invention, the user may use the headphones to listen to all sorts of transmitted sounds. If a user desires to listen to a recording or other sound transmission without using the surround sound, or echo features, a switch may be included allowing the user to switch between utilization of the separation device, utilization of the delaying device, and utilization of neither the separation device nor the delaying device. The switch may be located directly on the headset. The switch may also be located on a plug similar to that described above.

One of the speakers in each casing may be positioned closer to each of the user's ear auricles than the remaining speakers. Arranging some speakers closer to the user's ear auricles than other speakers allows secondary sounds such as echoes and background, while the user is still not distracted from the primary sounds coming from the speakers closer to his or her ear auricles. Also, if the speakers located farther from the user's ear auricles are positioned in the casings near the hindmost or front portions of the user's ear, the secondary sounds may seem to be coming from behind, or in front of the user. Similarly, if the secondary speakers are positioned in the casings near the top or bottom portions of the user's ear, the secondary sounds may seem to be coming from above or below the user.

Some speakers may be positioned within the left and right auricles of the user's ear. In such an embodiment, the headphones could be extremely lightweight, as the speakers located within the auricles of the user's ear may be in casings that are supported in place by the ear auricles themselves.

The headphone system may also include separate volume controls, each volume control regulating the amplification of the sound coming from each of the speakers in each set. The volume controls may be included directly on the speaker casings, or on the headband portion of the headset. The controls for each speaker may also be remotely located relative to the headset, such as on a remote stereo sound system.

In another embodiment of the invention, a set of at least two chambers may be located in each casing. Each chamber is included to house an individual speaker. By individually housing speakers, each chamber may position the speaker. As a result, the speakers may direct sound toward the user's ears.

DETAILED DESCRIPTION OF THE PREFERRED EMBODIMENTS

Figures 1, 2:
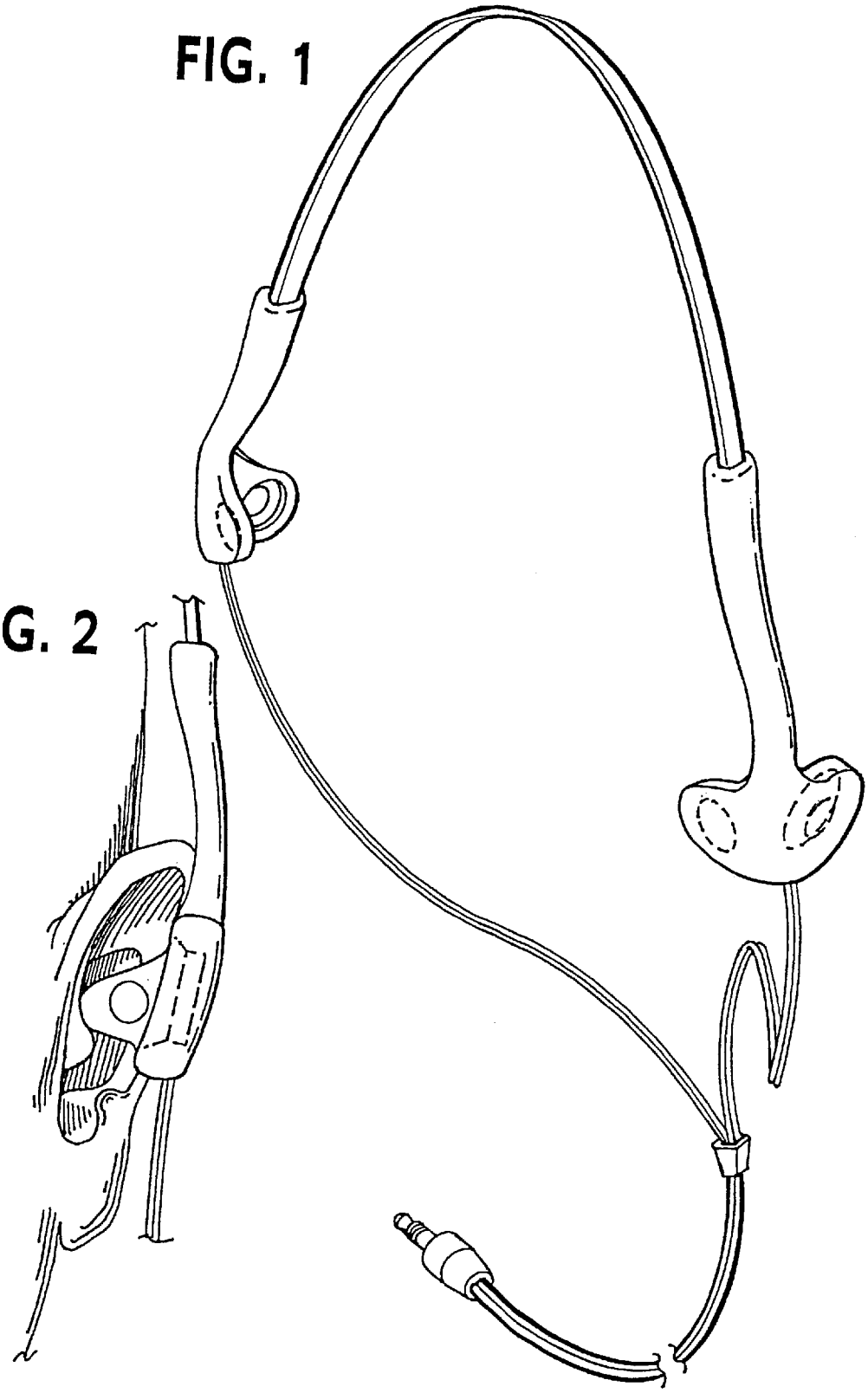
FIG. 1 shows a rear side view of a first embodiment of the headphone set, along with attached wiring and a plug.
FIG. 2 shows a front view of one headphone in a first embodiment of the headphone set, as the headphone would fit in a user's ear.

The above-described needs are met by the stereo headphone set shown in FIGS. 1 to 8. The headset of FIG. 1 includes a headset (11), including left and right casings (12, 22). The left casing (12) may be positioned near or against a user's left ear when in use, and the right casing (22) may be positioned near or against the user's right ear when in use. Two sets of speakers (13, 14, 23, 24) are attached to or housed within the casings (11, 22). Each set of speakers may include one or more delayed or high frequency speakers (13, 23). These speakers (13, 23) produce delayed or high frequency sounds relative to other speakers that are in the set. Although the headphones shown contain only two speakers, other speakers could also be included in each set. For example, speakers producing relatively low frequency sounds, or additionally delayed sounds may be included in each set. Regardless of the number of speakers, each speaker in each set may be capable of receiving individual signals from separate channels.

Figure 3:
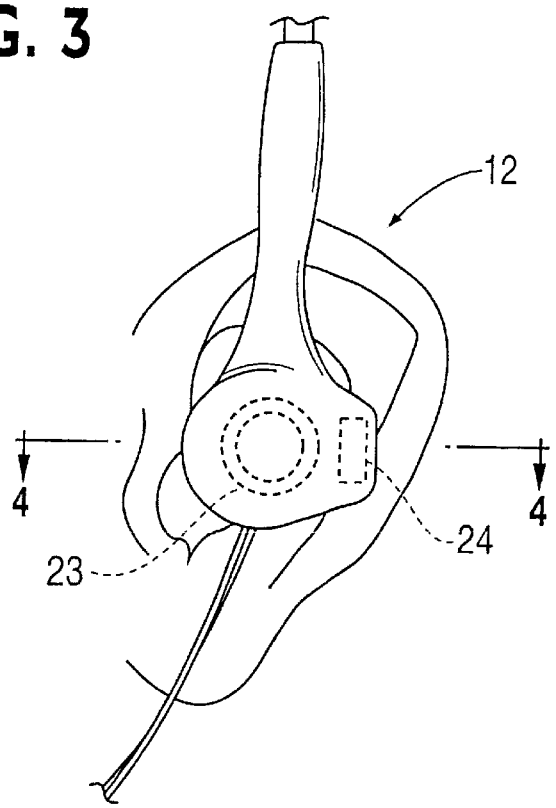
FIG. 3 shows an outer side view of one headphone in a first embodiment of the headphone set, as the headphone would fit in a user's ear.

As shown in FIG. 2, one of the speakers (14, 24) in each casing (12, 22) may be positioned closer to each of the user's ear auricles than the remaining speakers. Arranging some speakers closer to the user's ear auricles than other speakers allows the user to perceive secondary sounds such as echoes and background, while the user is not distracted from the primary sounds coming from the speakers (13, 23) closer to his or her ear auricles. Also, speakers (14, 24) are located farther from the user's ear auricles relative to other speakers. This may be accomplished by positioning the speakers (14, 24) in the casings near the hindmost or front portions of the user's ear. FIG. 3 shows the speakers being located near the hindmost portion of the user's ear. The user in this case perceives the secondary sounds as seemingly coming from behind the user. The opposite effect would result if the speakers (14, 24) were positioned near the front portion (not shown) of the user's ear. The secondary speakers (14, 24) could also be positioned in the casings near the top or bottom portions (not shown) of the user's ear. As a result, the secondary sounds would be perceived to be coming from above or below the user.

As shown in FIG. 2, at least one speaker (14) in each set may be positioned within the left or right auricles of the user's ear. In the embodiment of FIGS. 1 to 4, the headphones are extremely lightweight. In another embodiment (not shown), the speakers located within the auricles of the user's ear may be in casings that are supported in place by the ear auricles themselves. In such an embodiment, the headband (15) would not be necessary. The casings (12, 22) would also be much smaller than is shown in the figures.

Figure 4:
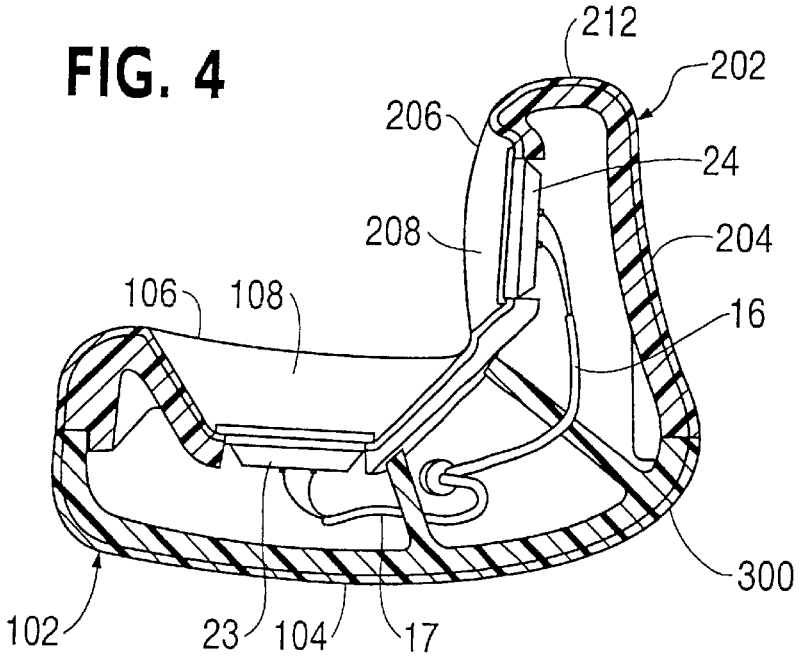
FIG. 4 shows a top cross sectional view of one headphone in a first embodiment of the headphone set.

FIG. 4 is a top cross sectional view of the left casing (22). Although the left casing (22) is depicted within FIG. 4, this figure is equally applicable to the right casing (12). FIG. 4 shows that the speaker (13, 23) receives signals from channel (17), and speaker (14, 24) receives signals from channel (16). The channels (16, 17) are separate channels. As further depicted within FIG. 4, the left casing (12) and the right casing (22) each have a first projection (102) and a second projection (202).

The first projection (102) encases speaker (13, 23). The exterior surface of the first projection (102) has an outer surface (104) and an inner surface (106). The inner surface (106), being closer to the ear than the outer surface (104), has an opening (108) for the speaker (13, 23). The opening (108) is near the center of the first projection (102). The base portion of the opening (108) is in contact with an edge of the speaker (13, 23) to form a first speaker face, while the rim portion of opening (108) is located at the inner surface (106).

The second projection (202) encases speaker (14, 24). In addition, the second projection (202) is structurally adapted for insertion into the auricle of the ear, with the auricle end (212) of the second projection (202) being positioned closer to the ear auricle than the first projection (102). The exterior surface of the second projection (202) also has an outer surface (204) and an inner surface (206). The inner surface (206) has an opening (208) for the speaker (14, 24). The opening (208) is near the center of the second projection (202). The base portion of the opening (208) is in contact with an edge of the speaker (14, 24) to form a second speaker face, while the rim portion of the opening (208) is located at the inner surface (206).

As shown in FIG. 4, the elbow (300) is located at a distal end of the first projection (102) and at a distal end of the second projection (202). Specifically, the first projection (102) protrudes from the second projection (202) at the elbow (300). Likewise, the second projection (202) protrudes from the first projection (102) at the elbow (300). As seen in FIG. 4, the outer surface (104) and the outer surface (204), in conjunction, form the outer exterior surface of the casing (12, 22). The inner surface (106) and the inner surface (206), in conjunction, form the inner exterior surface of the casing (12, 22). The protrusions of first projection (102) and the second projection (202), along with the first speaker face being positioned substantially normal to the second speaker face, results in a V-shaped casing (12, 22) having a vertex at the elbow (300).

Figure 5:
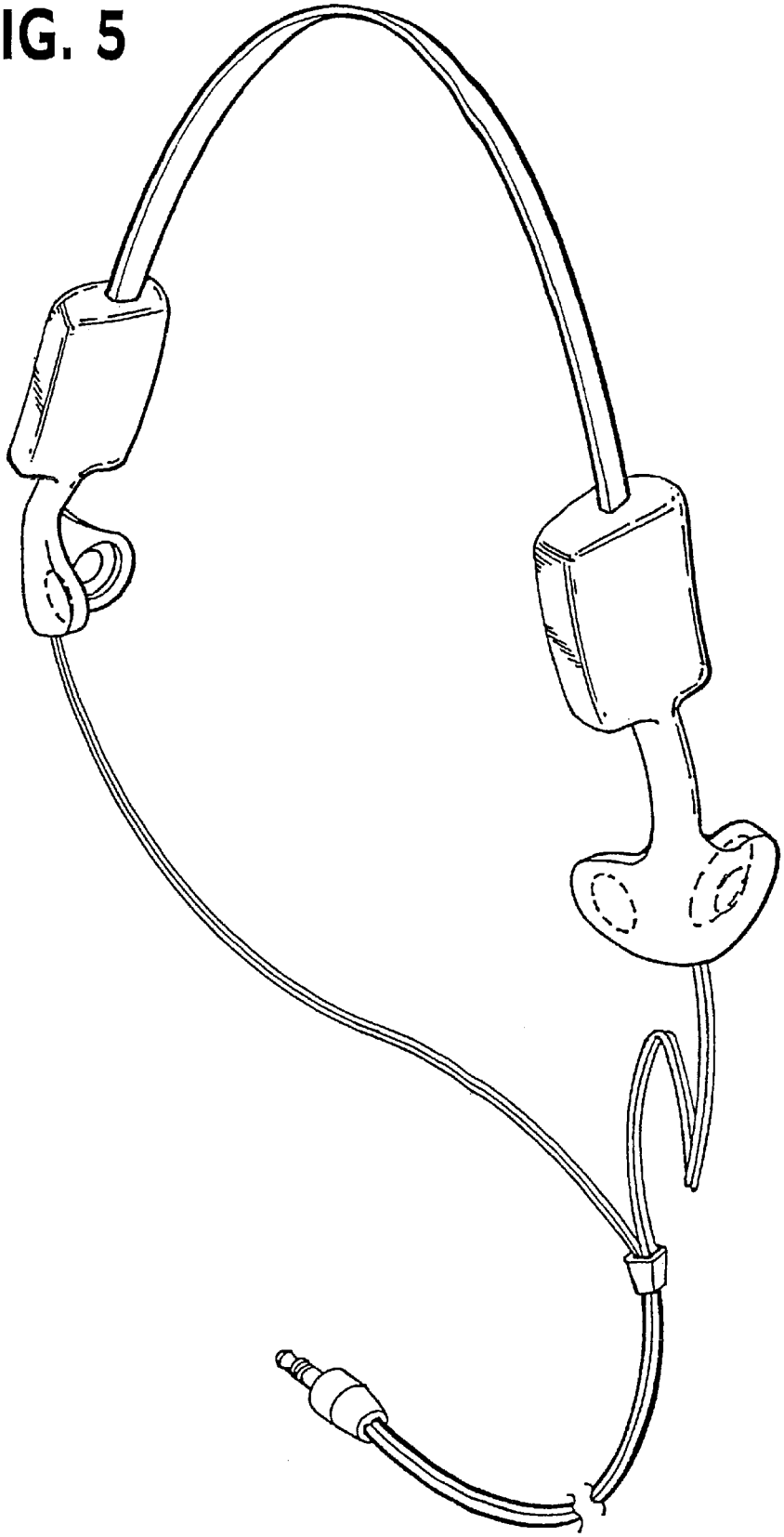
FIG. 5 shows a rear side view of a second embodiment of the headphone set, with the surround sound electronics located on the headphone set itself.

The stereo headphone set includes an electronic equipment which separates one or more individual signals into two or more signals. The separation can result in one signal that transmits delayed sounds or sounds of high frequencies relative to the sounds transmitted by remaining signals. As shown in FIG. 5, in one embodiment of the invention the signal separating equipment (19, 20) is located directly on the headset. Although FIG. 5 shows signal separation equipment (19, 20) located within each casing for each set of speakers, other variations are possible. For example, the signal separation equipment may be held in a unitary casing located at the top of the headband. Alternatively, the signal separation equipment may be located directly at a source location, such as an amplifier on a home stereo system. As shown in FIG. 1, the signal separation equipment may be located on a plug (25) that fits within an output jack from a home stereo system, a personal stereo, or any other suitable source. In either embodiment, the plug may be attached to the headset by a cord (21). The plug (25) may be adapted to combine with and receive signals from a port located in a remote stereo sound system. In such an embodiment, the signals may be transmitted to the headphone set without using an electrical cord as a carrier of the signals.

As mentioned above, the signal separation equipment (18, 19, 20) may include a delaying device for delaying at least one of the separated signals before it is transmitted to a speaker. The delayed signal may be channeled to one or more speakers, while the signal that is not delayed may be channeled to other speakers. This separation and delay procedure may produce an echo or reverberation effect for a listener. A user may desire to use the echo or reverberation effect when listening to sounds that are not originally recorded with the intention that they be retransmitted and received using surround sound technology.

In a preferred embodiment of the invention, the user may use the headphones to listen to all sorts of transmitted sounds. If a user desires to listen to a recording or other sound transmission without using the surround sound or echo features, a switch (27) may be included allowing the user to switch between utilization of the separation device, utilization of the delaying device, and utilization of neither the separation device nor the delaying device. As shown in FIG. 1, the switch may be located directly on the headset (15). The switch (27) may also be located with signal separation equipment located on the plug (25), or away from the headset, similarly to the embodiments described above.

The headphone system may also include separate volume controls (26), each volume control regulating the amplification of the sound coming from each of the speakers 13, 14, 23, 24) in each set. The volume controls may be included directly on the speaker casings, or elsewhere on the headset, as shown in FIG. 1. The controls for each speaker may also be remotely located relative to the headset, such as on a remote stereo sound system.

Figure 8:
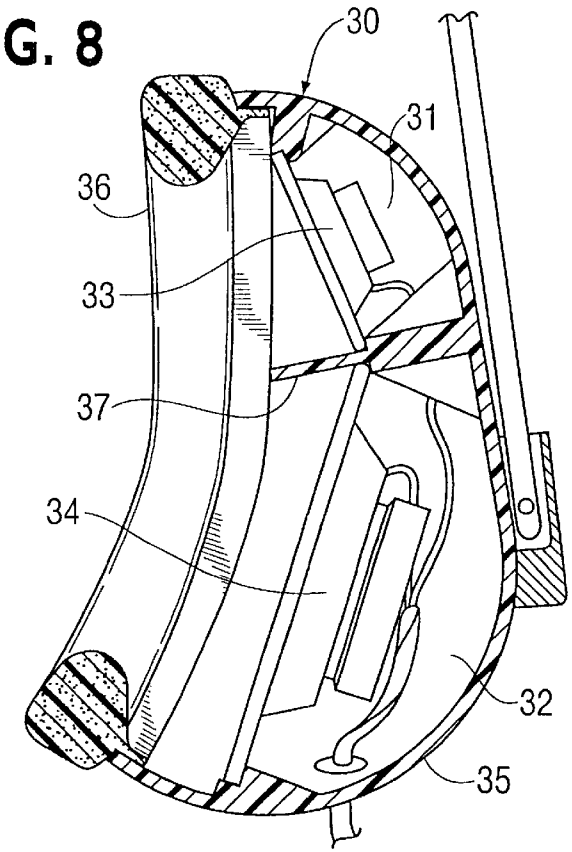
FIG. 8 shows a front side cross sectional view of one headphone in a third embodiment of the headphone set.
Figure 7:
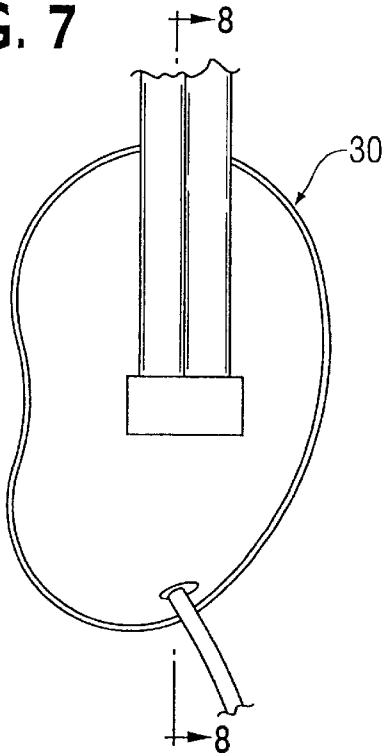
FIG. 7 shows an outer side view of one headphone in a third embodiment of the headphone set.
Figure 6:
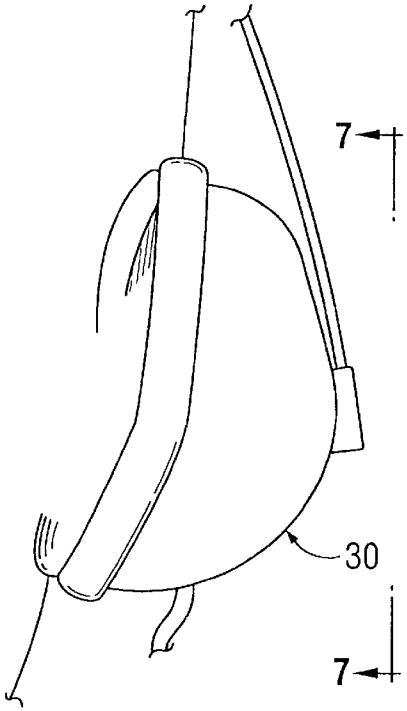
FIG. 6 shows a front view of a one headphone in a third embodiment of the headphone set, as the headphone would be worn by a user.

In FIGS. 6 to 8, another embodiment of the invention is described. As shown in FIG. 8, a set of at least two chambers (31, 32) is located in each casing (30). Each chamber (31, 32) is different in size and structurally adapted to house an individual speaker (33, 34). By individually housing speakers (33, 34), each chamber (31, 32) may position the respective speakers (33, 34). The speakers (33, 34) may therefore direct sound toward or away from the user's ears.

Also shown in FIGS. 6 through 8, the casing (30) includes a casing body (35) having a bowl shape. By having this bowl shape, the sound emanating from the speakers (33, 34) is distributed around the opening of the ear.

In the embodiment of FIGS. 6 to 8, the larger casing may allow each headphone to fit around a user's ear, as shown in FIG. 6. The rim (36) has an arched contour, as shown in FIGS. 6 and 8. The arch contour of the rim (36) aids in both aiming the speakers, and in forming the casing closely around the user's ear. As shown in FIG. 7, the shape of the headphone casing may also allow the casing to fit an ear more comfortably than shell type earphones normally found in the art.

Along with the bowl-shaped casing body (35), the arc contour of the rim (36) results in the casing (30) having a profile in the shape of a crescent. Specifically, as shown in the sectional elevation of FIG. 8, the casing (30) is bounded by a convex exterior portion and a concave exterior portion. The profile of the convex exterior portion is the casing body (35), while the profile of the concave exterior portion is influenced by the rim (36).

The chamber (31) is separated from the chamber (33) by a common chamber wall (37). While the chamber wall (37) is substantially perpendicular to the casing body (35), the chamber wall (37) is at an oblique angle with the rim (36). Furthermore, the casing body (35) is asymmetrical with respect to the chamber wall (37).

Although figures show only two speakers housed in each casing, more speakers may be included producing sounds from different types of signals, as described above with regard to other embodiments of the invention. Accordingly, it is to be understood that the invention is not limited to any of the precise embodiments described herein. Various changes and modifications could be effected by one skilled in the art without departing from the spirit or scope of the invention as defined in the appended claims.

What is claimed is:

1. A stereo headphone set comprising:

a plurality of casings, each casing of said plurality of casings having a first projection, a second projection, and an exterior surface;

said first projection of said casing having an external surface, said external surface of said first projection including a first projection outer surface and a first projection inner surface, said first projection inner surface being closer to an ear auricle than said first projection outer surface;

said second projection of said casing, being structurally adapted for insertion within said ear auricle, being positioned closer to said ear auricle than said first projection, and having an external surface, said external surface of said second projection including a second projection outer surface and a second projection inner surface; and said exterior surface of said casing having an inner surface and an outer surface, wherein said first projection outer surface and said second projection outer surface conjointly form said outer surface, and wherein said first projection inner surface and said second projection inner exterior surface conjointly form said inner surface.

2. A stereo headphone set of claim 1 wherein:

said casing is V-shaped.

3. A stereo headphone set of claim 1 further comprising:

an elbow located at a distal end of the first projection and at a distal end of the second projection, said first projection protruding from the second projection at said elbow and said second projection protruding from said first projection at said elbow.

4. A stereo headphone set of claim 3 wherein:

said each casing is V-shaped, having a vertex at said elbow.

5. A stereo headphone set of claim 1 wherein:

said first projection further comprises at least one first speaker, and said second projection further comprises at least one second speaker.

6. A stereo headphone set of claim 5 wherein:

said casing is V-shaped.

7. A stereo headphone set of claim 5 further comprising:

an elbow located at a distal end of the first projection and at a distal end of the second projection, said first projection protruding from the second projection at said elbow and said second projection protruding from said first projection at said elbow.

8. A stereo headphone set of claim 5 wherein:

said at least one first speaker having a speaker face that is substantially parallel with said first projection inner surface;

said at least one second speaker having a speaker face that is substantially parallel with said second projection inner surface; and said first speaker face is positioned substantially normal to said second speaker face.

9. A stereo headphone set of claim 5 wherein:

said first projection further comprises a first opening for said at least one first speaker, and said second projection further comprises a second opening said for at least one second speaker.

10. A stereo headphone set of claim 9 wherein:

said first opening is in contact with said at least one first speaker to form a first speaker face, and said second opening is in contact with said at least one second speaker to form a second speaker face.

11. A stereo headphone set of claim 10 wherein:

said first speaker face is positioned substantially normal to said second speaker face.

12. The stereo headphone set of claim 5, further comprising:

an apparatus for supplying at least one first signal to said at least one first speaker and for supplying at least one second signal to said at least one second speaker.

13. The stereo headphone set of claim 12 wherein:

said first signal is different from said second signal.

14. A stereo headphone set of claim 12 further comprising:

a headband fastened to said casing, said apparatus being attached to said headband.

15. The stereo headphone set of claim 12 wherein:

said apparatus is located on a plug, and said plug being attached to said headset by a cord, and being adapted to combine with and receive signals from a port located in a remote stereo sound system.

16. The stereo headphone set of claim 12 wherein:

at least one second speaker comprises a plurality of speakers, and a speaker of said plurality of speakers is positioned closer to said ear auricle than another speaker of said plurality of speakers.

17. The stereo headphone set of claim 16 wherein:

said apparatus for supplies a separate, individual signal to each speaker of said plurality of speakers.

18. The stereo headphone set of claim 12 wherein:

said apparatus delays at least one of said first signal and said second signal to produce a delayed signal.

19. The stereo headphone set of claim 18 wherein:

said delayed signal is channeled to one of said at least one first speaker and said at least one second speaker, and a signal other than said delayed signal is channeled to another of said at least one first speaker and said at least one second speaker.

20. The stereo headphone set of claim 12 wherein:

said apparatus produces an echo or reverberation effect.

21. A stereo headphone set of claim 1 wherein:

said plurality of casings comprises a casing for a left ear auricle and a casing for a right ear auricle.

22. A stereo headphone set of claim 1 further comprising a headband attached to said casing.

23. A stereo headphone set comprising:

a plurality of casings, each casing of said plurality of casings, being bounded by a convex exterior portion and a concave exterior portion and having a profile in the shape of a crescent, said each casing including:

at least two chambers, one chamber of said at least two chambers being different in size that another chamber of said at least two chambers, and each chamber of said at least two chambers being structurally adapted to house at least one speaker;

a chamber wall, said chamber wall separating said one chamber of said at least two chambers from said another chamber of said at least two chambers;

a bowl-shaped casing body, said casing body being asymmetrical and having said convex exterior; and an arc-shaped rim, said rim influencing the profile of said concave exterior portion.

24. A stereo headphone set of claim 23 wherein said casing body is asymmetrical in relation to said chamber wall.

* * * * *